United States Patent [19]

Swain

[11] 4,092,033

[45] May 30, 1978

[54] SKATEBOARD HAVING A FLEXIBLE AND RESILIENT CHASSIS WITH SPEED CONTROL MEANS

[75] Inventor: Stephen C. Swain, Westport, Conn.

[73] Assignee: March Enterprise, Westport, Conn.

[21] Appl. No.: 729,659

[22] Filed: Oct. 5, 1976

[51] Int. Cl.[2] ..... B62B 7/00

[52] U.S. Cl. ..... 280/87.04 A; 188/195

[58] Field of Search ..... 280/87.04 A, 87.04 R, 280/87.01, 87.02 R, 87.03, 11.2, 11.21, 1.1 R, 1.21, 1.22, 1.182, 1.181; 188/195

[56] References Cited

U.S. PATENT DOCUMENTS

| | | | |
|---|---|---|---|
| 1,890,755 | 12/1932 | Shepherd | 280/87.03 |
| 2,729,464 | 1/1956 | O'Donnell | 280/1.183 X |
| 2,738,199 | 3/1956 | Rand | 280/1.182 |
| 3,765,693 | 10/1973 | Morrison | 280/1.182 |
| 3,954,279 | 5/1976 | Guerr | 280/87.04 A |

*Primary Examiner*—Joseph F. Peters, Jr.
*Assistant Examiner*—John A. Pekar
*Attorney, Agent, or Firm*—Richard J. Birch

[57] ABSTRACT

A skateboard having a flexible and resilient, generally planar chassis to which are affixed front and rear wheel assemblies. The skateboard includes a braking mechanism for controlling the speed of at least one of the wheel assemblies. Engagement and disengagement of the braking mechanism is controlled by and responsive to the amount and direction of the flexing of the skateboard chassis.

21 Claims, 11 Drawing Figures

SKATEBOARD HAVING A FLEXIBLE AND RESILIENT CHASSIS WITH SPEED CONTROL MEANS

BACKGROUND OF THE INVENTION

This invention relates to skateboards in general, and more particularly, to a skateboard having speed control means.

The resurgence of interest in skateboards has been well documented in the press during the last year. Skateboards were first seen in the mid-60s when surfers used them to practice and develop their surfing skills on "sidewalk surfboards." Over the last decade, attempts to improve the control and stability of skateboards have significantly advanced skateboard design and construction. The new skateboard, with its flexible chassis, wide, stable steering trucks and precision bearing urethane wheels, is a far cry from the "sidewalk surfer" of the 1960s. These improvements have made skateboarding safer and more enjoyable for a larger group of people and now skateboarding has come into its own both as a recreational activity and as a sport in which amateurs and professionals alike can compete for prizes in events ranging from freestyle acrobatics to high-speed slalom and downhill racing.

Unfortunately, with the increase in skateboarding popularity there has been a concomitant increase in skateboard related injuries. At present, the direction and speed of the skateboard is limited to the dexterity of the rider. Directional control is achieved by leaning in the direction one would like to steer. Speed control is achieved by steering transversely to the hill in a zig-zag manner. The only practical way for the rider to stop is to jump off his skateboard because the current skateboards have no brakes.

Jumping from the skateboard imposes some very obvious and dangerous constraints on the skateboard rider. This is especially pertinent because skateboarding has now become a high-speed, hill coasting sport. Additionally, once the skateboard rider has fallen or jumped from his skateboard, the skateboard continues to plummet down the hill and many have been injured by run-away skateboards.

The art of coasters and roller skates contains various illustrations of braking systems. Examples of such braking systems are shown in the following U.S. Pat. Nos: 225,361; 1,026,712; 1,890,755; 2,014,060; 3,180,678; 3,224,785 and 3,288,251. The ground contacting rub block braking systems shown in U.S. Pat. Nos. 225,361 and 1,890,755 are not suitable for controlling modern day high-speed skateboards. The wheel contacting braking systems shown in the other patents are generally unsatisfactory or impractical for skateboards.

It is accordingly a general object of the present invention to provide an improved skateboard with speed-control means.

It is a specific object of the invention to provide a speed control means that does not require steering changes to maintain speed control.

It is another object of the invention to provide a speed control means for braking to a full stop without jumping from the skateboard.

It is still another object of the invention to provide for automatic engagement of the speed-control means when the rider either jumps or falls off of the skateboard.

It is a further object of the invention to provide a skateboard having a flexible and resilient, generally planar chassis in which the amount and direction of flexing of the chassis controls the proportional engagement and disengagement of the brake means.

It is still a further object of the invention to provide a skateboard with speed-control means in which the degree of speed reduction is controlled by the rider's position and physical attitude on the skateboard.

It is a feature of the invention that the rider's position for brake engagement is instinctive and is a position that is best suited for the rider to resist the deacceleration forces of braking.

It is another feature of the invention that overbraking will cause a weight shift or dispostion of the rider which automatically disengages the brake.

It is still another feature of the present invention that the rider's position for disengaging the brake is a position best suited for the acceleration of the board after the speed control has been disengaged.

It is a further feature of the invention that the rider's position upon disengagement of the speed control means is the typical and normal riding position for control of the skateboard.

It is still a further feature of the invention that the natural resiliency of the skateboard chassis can be employed to operate a brake that is engaged automatically when the rider is not on the board and when the rider is on the board the brake can be released or engaged by the position and physical attitude of the rider.

It is an additional feature of the invention that existing yieldable, resilient skateboard can be modified to provide a skateboard having the desired speed control means.

Figure 1:
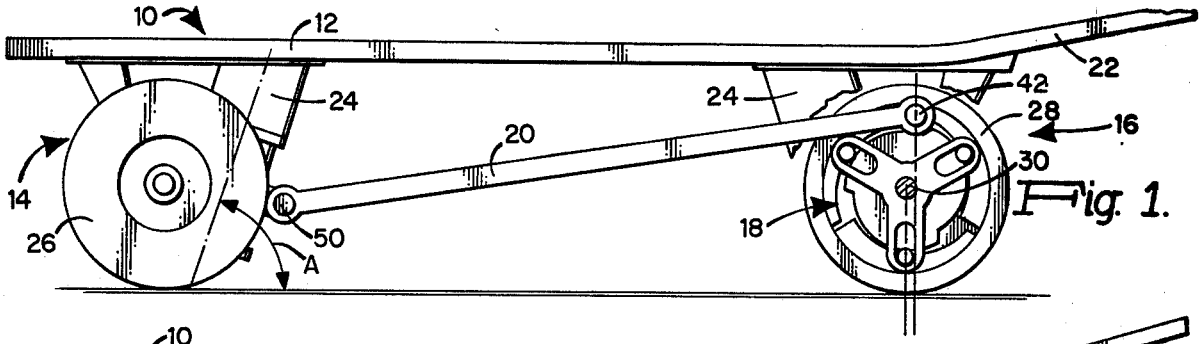
FIG. 1 is a view in side elevation showing an unloaded, flexible and resilient chassis skateboard having a brake mechanism which is depicted in the engaged position.
Figure 2:
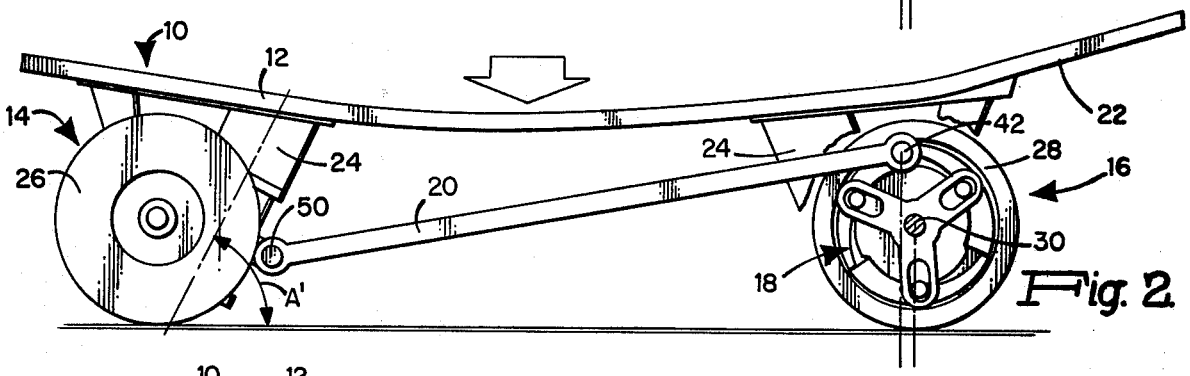
FIG. 2 is a side elevational view of the skateboard of FIG. 1 showing the chassis in a first loaded condition for disengaging the brake mechanism.
Figure 3:
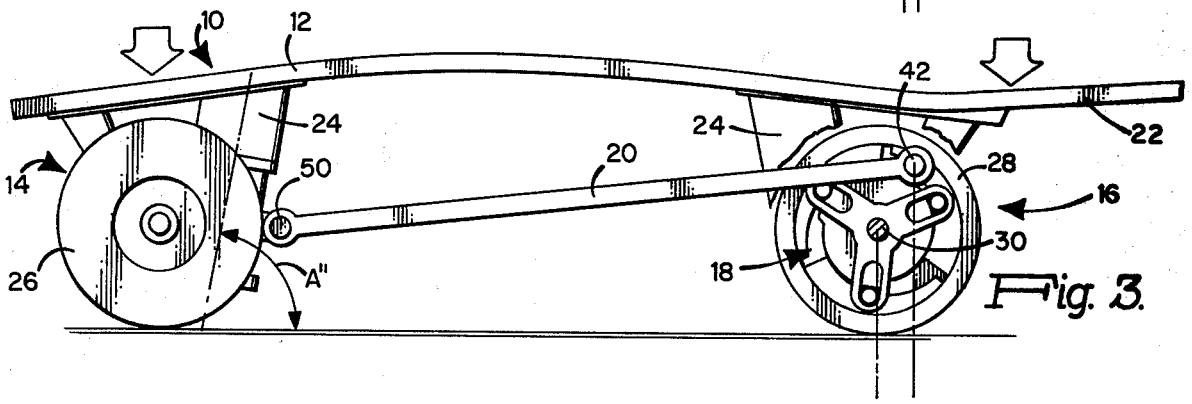
FIG. 3 is another side elevational view of the skateboard of FIG. 1 showing the chassis in a second loaded condition for engaging the brake mechanism.
Figure 4:
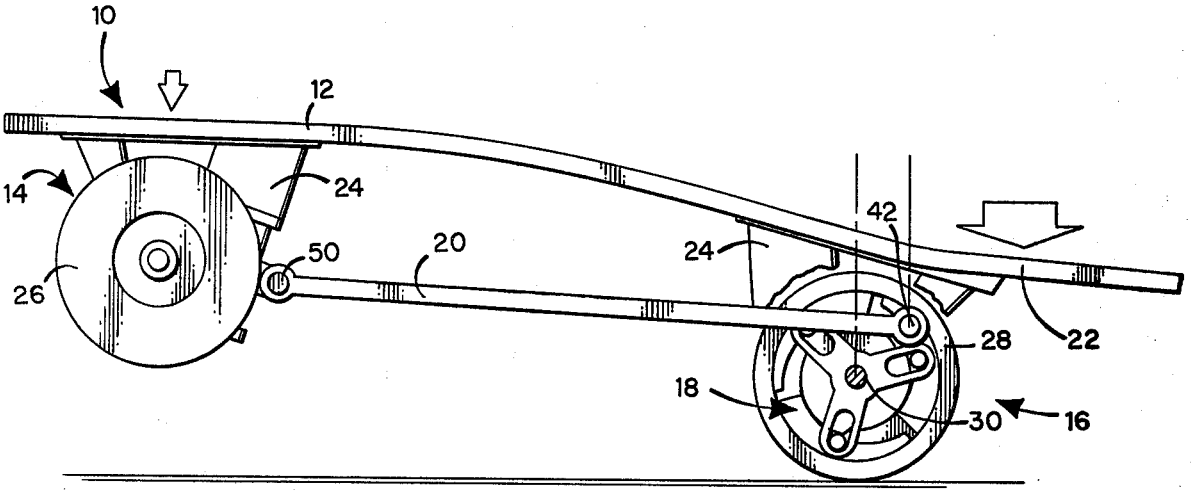
FIG. 4 is still another side elevational view of the skateboard of FIG. 1 showing the second loaded condition of the skateboard in FIG. 3 together with tilting of the chassis to provide greater breaking force than that achieved when the skateboard is loaded and positioned as shown in FIG. 3.
Figure 10:
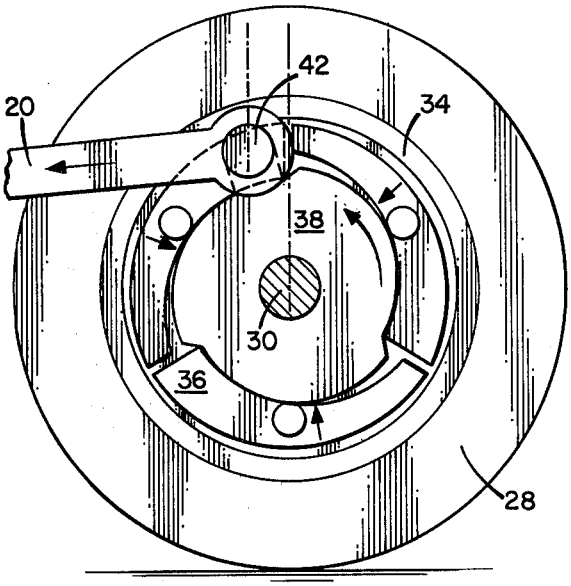
Figure 11:
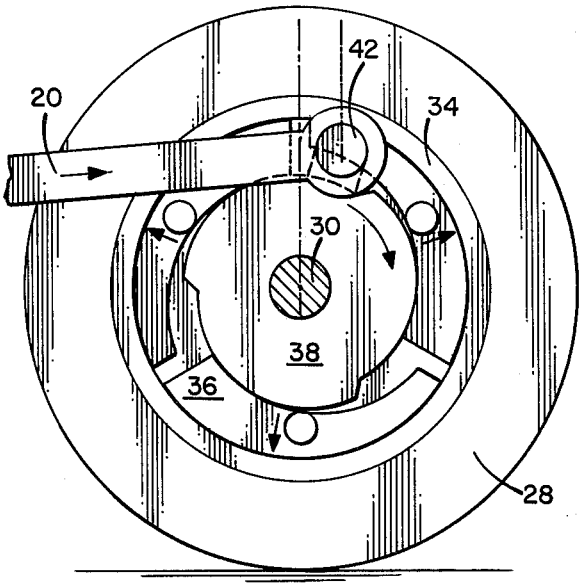
Figure 9:
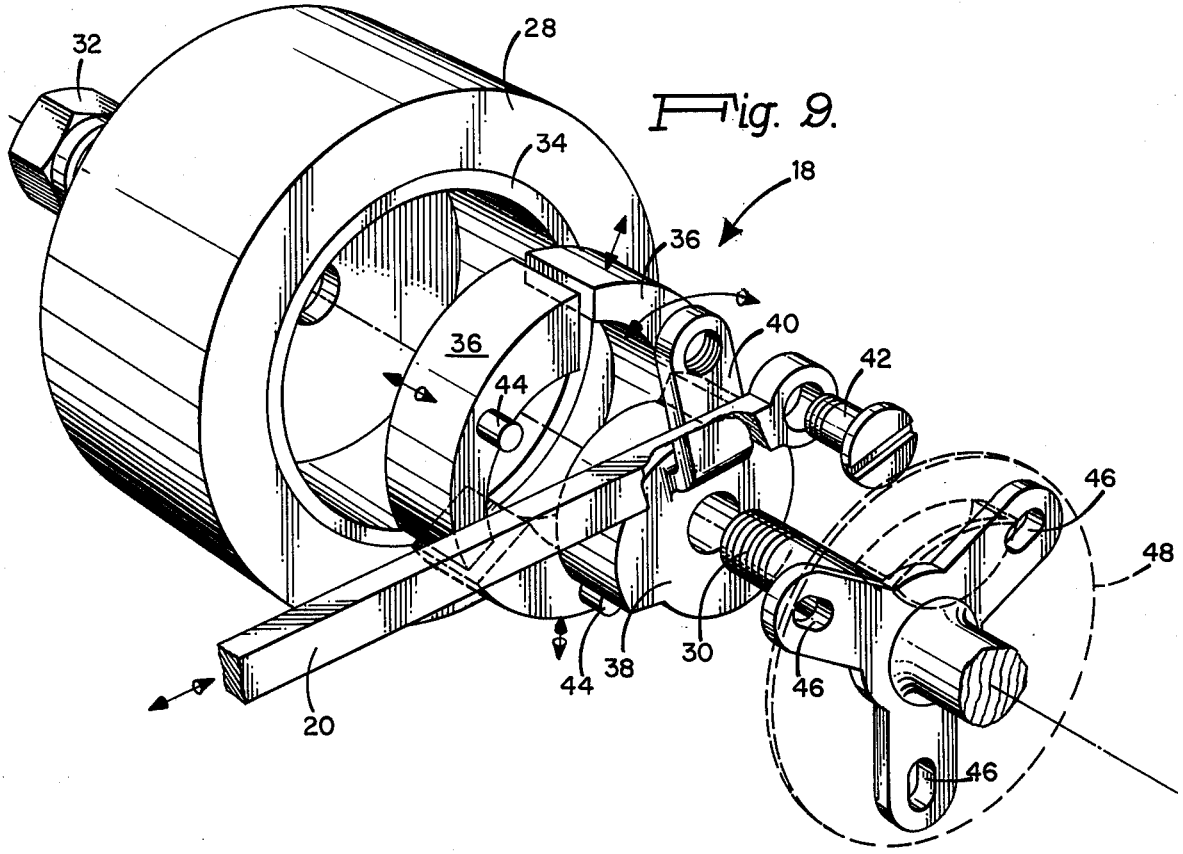

FIGS. 5, 6, 7 and 8 are diagrammatic views of the skateboard shown in FIGS. 1 through 4, respectively, illustrating the unloaded chassis of FIG. 1 without a rider and the position of the skateboard rider for the loaded chassis conditions depicted in FIGS. 2 through 4;

FIG. 9 is an exploded view in perspective of the brake mechanism;

FIG. 10 is a view in side elevation of the brake mechanism in the disengaged position; and, FIG. 11 is another view in side elevation of the brake mechanism showing the brake mechanism in the engaged position.

DETAILED DESCRIPTION OF A PREFERRED EMBODIMENT

Turning now to the drawings, there is shown a skateboard with brake means constructed in accordance with the present invention and indicated generally by the reference numeral 10. The skateboard 10 comprises: a flexible and resilient, generally planar chassis 12 having mounted thereon front and rear wheel assemblies 14 and 16, respectively; a brake mechanism, indicated generally by the reference numeral 18 and shown in greater detail in FIGS. 9 through 11, and a brake linkage actuator 20.

The flexible and resilient, planar skateboard chassis 12 is formed preferably of aluminum or plastic, either solid or laminated, with a predetermined degree of yielding for a given load. A wide variety of currently available skateboards can be used for the chassis 12. Although the chassis has been described as "generally planar" it should be understood that the chassis can have an upwardly swept rear portion 22, commonly termed a "kicktail" and/or an upwardly bowed center portion, commonly referred to as a "camber." Both of these configurations are included within the term "generally planar" as used herein.

The chassis 12 can be constructed as a single unit or as a plurality of units. In the latter case, a rigid rear portion can be connected to a flexible forward portion or two rigid portions can be joined by a resilient, flexible connection. In each of these instances, the connection is located in front of the wheel axis of the rear assemblies. The term "flexible and resilient chassis" as used herein shall be construed to include all of these chassis configurations.

The front wheel assembly 14 comprises a truck unit 24 upon which are mounted wheels 26. The truck unit 24 is a conventional truck unit that is readily available in the marketplace. One representative example of a suitable truck unit is the "Tracker" truck. The wheels 26 can be formed from a variety of materials, but preferably are the commercially available standard urethane wheels.

The rear wheel assembly 16 includes a truck unit 24 and rear wheels 28 at least one of which is provided with the brake mechanism 18. For purposes of simplicity, the rear truck unit has been illustrated as a non-steerable unit. It should be understood that if steerable truck units are employed for the rear truck, the brake linkage 20 should be connected to the truck at its center of steering in order to prevent engagement or disengagement of the brake as a result of steering.

The major components of the brake mechanism 18 are best viewed in FIGS. 9 through 11. Referring to these Figures, rear wheel 28 is rotatably mounted on a threaded axle 30 and retained thereon by locking nut 32. A brake drum 34 is mounted within and and secured to the rear wheel 28. Radially movable brake shoes 36 are positioned within brake drum 34 for radial movement toward and away from the brake drum. The movement of the brake shoes 36 is controlled by means of a brake shoe cam 38 that is rotatably mounted on axle 30. The brake shoe cam 38 has an actuator arm 40 that is rotatably mounted with respect to the brake linkage 20 by means of an actuator pin 42.

It can be seen from an inspection of FIGS. 9 through 11 that longitudinal movement of the brake linkage 20 will rotate the brake shoe cam actuator 40 about the axle 30. This rotational movement causes the brake shoe cam 38 to bear against the brake shoes 36 thereby moving the brake shoes radially outward against the brake drum 34. Rotation of the brake shoes 36 is prevented by means of brake shoe pivot pins 44 which are slidably mounted within slots 46 formed in a brake shoe cage 48 that is secured to truck axle 30.

Referring back to FIGS. 1–4, it can be seen that the brake lingage 20 is pivotally mounted at pivot 50 with respect to the front wheel assembly 14 and pivotally mounted with respect to the rear wheel assembly 16 and brake mechanism 18 as described above. Given this arrangement, any change in the angle of the truck units with respect to a reference plane or a change in the wheel length between the front and rear wheel assemblies will produce a movement of the brake actuator arm 40 and a concomitant movement of the brake shoes 36 to engage or disengage the brake mechanism.

Referring back to FIGS. 1 through 8, FIGS. 1 and 5 illustrate the skateboard of the present invention in an unloaded state with the brake mechanism in the engaged position. When the skateboard chassis is loaded by the weight of the rider in the position shown in FIGS. 2 and 6, the brake mechanism is disengaged. It can be seen from a comparison of FIGS. 1 and 2 that the brake actuator linkage 20 rotates pin 42 in a counterclockwise direction to disengage the brake mechanism. This action is shown in detail in FIG. 10.

Figures 5, 6, 7, 8:
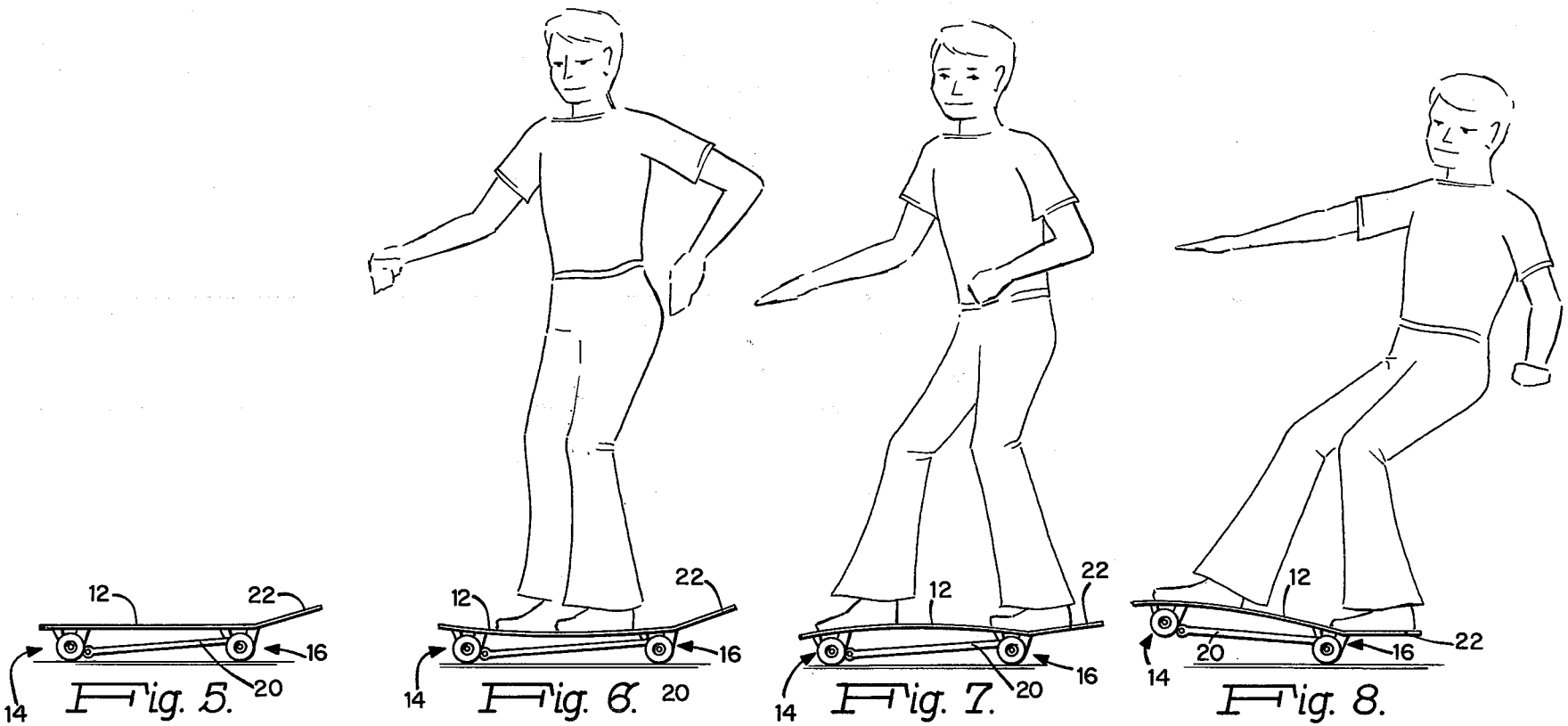

If the skateboard rider shifts his weight as shown in FIG. 7, the skateboard chassis is loaded in a second and different position from that shown in FIG. 2. The resulting weight shift produces the loading indicated in FIG. 3 by the arrows. This loading causes the brake linkage 20 to rotate pin 42 in a clockwise direction thereby engaging the brake mechanism. A detailed view of this action is illustrated in FIG. 11.

It should be observed that under the chassis loading conditions illustrated in FIGS. 1 through 3 there is a corresponding angular change of the truck units with respect to a reference plane e.g., the ground plane. This angular change is indicated as angle A, A′ and A″ in FIGS. 1 through 3, respectively. It can also be seen that there is a corresponding change in the distance between the front and rear wheel axes.

Additional braking force can be generated by loading the chassis at the locations shown in FIG. 3 and then tilting the chassis as shown in FIG. 4. The increased loading on the rear portion of the chassis is represented by the thicker arrow in FIG. 4.

It will be appreciated from the foregoing discussion that the brake mechanism is engaged automatically when the skateboard is in the unloaded state. Thus, if the rider jumps or falls off of the skateboard, the skateboard will stop automatically thereby preventing a runaway skateboard. The degree of brake engagement (from zero to full) in the unloaded state can be adjusted by varying the physical and/or angular relationships of the components e.g. shortening or lengthening the brake linkage actuator 20 or adjusting the angular relationship of the rear wheel assembly 16 with respect to the chassis, etc.

Although the preceding description has been directed to the operation of a brake mechanism, it will be appreciated that the mechanical action produced by the flexing of the chassis can be employed to operate a variety of different mechanisms. For example, if the skateboard has a battery powered brake light, the brake light can be energized through a switch that is closed by the action of the brake linkage 20. Sound devices and other warning apparatus can also be controlled by the present invention.

Having described in detail a preferred embodiment of my invention it will now be apparent to those skilled in the art that numerous modifications can be made therein without departing from the scope of the invention as defined in the following claims.

What I claim is:

1. A skateboard comprising:
   a. a generally planar, flexible and resilient, longitudinal chassis having upper and lower surfaces, a front portion, a central portion and a rear portion;
   b. front wheel means attached to the lower surface of the chassis at the front portion thereof;
   c. rear wheel means attached to the lower surface of the chassis at the rear portion thereof;
   d. brake means for controlling the speed of at least one of said wheel means; and,
   e. means responsive to the upward flexing of the central portion of said chassis for controlling the engagement of said brake means.

2. The skateboard of claim 1 wherein said means responsive to the flexing of the chassis includes means for engaging and disengaging the brake means in proportion to the amount of flexing of the chassis.

3. The skateboard of claim 1 further comprising means responsive to the downward flexing of the central portion of the chassis for disengaging the brake means.

4. The skateboard of claim 1 wherein said chassis has a portion extending rearwardly of said rear wheel means whereby maximum braking is achieved by bringing the chassis to a maximum flexed portion with the rear wheel means in contact with the ground and the front wheel means off of the ground.

5. The skateboard of claim 4 wherein said rearwardly extending portion of said chassis is a kicktail.

6. The skateboard of claim 1 wherein the central portion of said chassis has a first configuration in an unloaded state and a second configuration in a loaded state and further comprising means for engaging said brake means when said chassis central portion is in an unloaded state and for disengaging said brake means when the chassis central portion is in a loaded state.

7. A skateboard comprising:
   a. a generally planar, flexible and resilient longitudinal chassis having upper and lower surfaces, a front portion, a central portion and a rear portion;
   b. front wheel means comprising a truck assembly attached to the lower surface of the chassis at the front portion thereof and at least one wheel rotatably mounted on said truck assembly;
   c. rear wheel means comprising a truck assembly attached to the lower surface of the chassis at the rear portion thereof and at least one wheel rotatably mounted on such truck assembly;
   d. a brake means for controlling the speed of at least one of said wheel means wheels; and,
   e. means responsive to a change in the angular relationship of said front and rear wheel means truck assemblies with respect to a reference plane as a result of the upward flexing of the central portion of the chassis for engaging the brake means and of the 8. The skateboard of claim 7 wherein said reference plane is a wheel supporting surface.

9. The skateboard of claim 7 wherein said reference plane is coplanar with or parallel to the plane of said plannar chassis.

10. The skateboard of claim 7 wherein said brake means includes means for proportionally engaging and disengaging the brake means in response to the angular change of the truck assembly of the at least one wheel means wheel that is braked by said brake means.

11. The skateboard of claim 10 wherein the brake means includes means for engaging the brake means as the angular relationship between the truck assembly of the at least one wheel means wheel that is braked by said brake means and the reference plane changes in a first direction and for disengaging the brake means as said angular relationship changes in a second and opposite direction.

12. The skateboard of claim 7 wherein the central portion of said chassis has a first configuration in an unloaded state and a second configuration in a loaded state and further comprising means for engaging said brake means when said chassis central portion is in an unloaded state and for disengaging said brake means when the chassis central portion is in a loaded state.

13. A skateboard comprising:
   a. a generally planar, flexible and resilient longitudinal chassis having upper and lower surfaces, a front portion, a central portion and a rear portion;
   b. front wheel means attached to the lower surface of the chassis at the front portion thereof;
   c. rear wheel means attached to the lower surface of the chassis at the rear portion thereof;
   d. brake means for controlling the speed of at least one of said wheel means; and,
   e. means responsive to a change in distance between said front and rear wheel means as a result of the flexing of the chassis for engaging and disengaging said brake means.

14. The skateboard of claim 13 wherein said brake means includes means for engaging the brake means when the distance between said front and rear wheel means is decreased and for releasing the brake means when said distance is increased.

15. The skateboard of claim 14 wherein said brake means includes means for proportionally engaging and disengaging the brake means in response to to the amount of change in distance between said front and rear wheel means.

16. The skateboard of claim 13 wherein the central portion of said chassis has a first configuration in an unloaded state and a second configuration in a loaded state and further comprising means for engaging said brake means when said chassis central portion is in an unloaded state and for disengaging said brake means when the chassis central portion is in a loaded state.

17. A skateboard comprising:
   a. a generally planar flexible and resilient longitudinal chassis having upper and lower surfaces, a front portion, a central portion and a rear portion and which has a first configuration when the central portion is in an unloaded state and a second configuration when it is in a loaded state;
   b. front wheel means attached to the lower surface of the chassis at the front portion thereof;
   c. rear wheel means attached to the lower surface of the chassis at the rear portion thereof;
   d. brake means for controlling the speed of at least one of said wheel means; and,
   e. means for engaging said brake means when said central portion of the chassis is in an unloaded state and for disengaging said brake means when said central portion of the chassis is in a loaded state.

18. A skateboard comprising:

a. a generally planar, flexible and resilient, longitudinal chassis having upper and lower surfaces, a front portion, a central portion and a rear portion;
b. front wheel means attached to the lower surface of the chassis at the front portion thereof;
c. rear wheel means attached to the lower surface of the chassis at the rear portion thereof;
d. utilization means operable by the flexing of the central portion of said chassis; and,
e. means responsive to the flexing of the central portion of said chassis for operating said utilization means.

19. A skateboard comprising:
a. a generally planar, flexible and resilient longitudinal chassis having upper and lower surfaces, a front portion, a central portion and a rear portion;
b. front wheel means comprising a truck assembly attached to the lower surface of the chassis at the front portion thereof and at least one wheel rotatably mounted on said truck assembly;
c. rear wheel means comprising a truck assembly attached to the lower surface of the chassis at the rear portion thereof and at least one wheel rotatably mounted on said truck assembly;
d. utilization means operable by a change in the angular relationship of said front and rear wheel means truck assemblies with respect to a reference plane as a result of the flexing of the central portion of the chassis; and,
e. means responsive to the angular relationship of said front and rear wheel means truck assemblies with respect to a reference plane for operating said utilization means.

20. A skateboard comprising:
a. a generally planar, flexible and resilient longitudinal chassis having upper and lower surfaces, a front portion, a central portion and a rear portion;
b. front wheel means attached to the lower surface of the chassis at the front portion thereof;
c. rear wheel means attached to the lower surface of the chassis at the rear portion thereof;
d. utilization means operable by a change in distance between said front and rear wheel means as a result of the flexing of the central portion of the chassis; and,
e. means responsive to a change in distance between said front and rear wheels for operating said utilization means.

21. A skateboard comprising:
a. a generally planar, flexible and resilient longitudinal chassis having upper and lower surfaces, a front portion, a central portion and a rear portion;
b. front wheel means comprising a truck assembly attached to the lower surface of the chassis at the front portion thereof and at least one wheel rotatably mounted on said truck assembly;
c. rear wheel means comprising a truck assembly attached to the lower surface of the chassis at the rear portion thereof and at least one wheel rotatably mounted on said truck assembly;
d. utilization means operable by a change in the angular relationship between said front and rear wheel means truck assemblies as a result of the flexing of the central portion of the chassis; and,
e. means responsive to a change in the angular relationship between said front and rear wheel means truck assemblies for operating said utilization means.

* * * * *

UNITED STATES PATENT AND TRADEMARK OFFICE

CERTIFICATE OF CORRECTION

PATENT NO. : 4,092,033

DATED : May 30, 1978

INVENTOR(S) : Stephen C. Swain

It is certified that error appears in the above—identified patent and that said Letters Patent is hereby corrected as shown below:

Claim 7, line 60, after "the" insert -- downward flexing of the central position of the chassis for disengaging said brake means --.

Claim 15, line 40, delete the second occurrency of the word "to".

Signed and Sealed this

*Fourth* Day of *March 1980*

[SEAL]

*Attest:*

SIDNEY A. DIAMOND

*Attesting Officer*

*Commissioner of Patents and Trademarks*